US010420452B2

(12) United States Patent
Hong et al.

(10) Patent No.: US 10,420,452 B2
(45) **Date of Patent: *Sep. 24, 2019**

(54) DISH WASHING MACHINE

(71) Applicant: Samsung Electronics Co., Ltd., Suwon-si, Gyeonggi-do (KR)

(72) Inventors: Kwan Woo Hong, Suwon-si (KR); Jeong Hoon Kang, Seoul (KR); Dae Uk Kang, Hwaseong-si (KR); Ha Yeon Jo, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/970,694

(22) Filed: May 3, 2018

(65) Prior Publication Data

US 2018/0249883 A1 Sep. 6, 2018

Related U.S. Application Data

(63) Continuation of application No. 14/885,620, filed on Oct. 16, 2015, now Pat. No. 9,980,625.

(30) Foreign Application Priority Data

Oct. 6, 2014 (KR) ..... 10-2014-0139424

(51) Int. Cl.
*A47L 15/42* (2006.01)
*A47L 15/16* (2006.01)

(52) U.S. Cl.
CPC ..... *A47L 15/4282* (2013.01); *A47L 15/16* (2013.01); *A47L 15/4209* (2016.11)

(58) Field of Classification Search
CPC ..... A47L 15/506
See application file for complete search history.

(56) References Cited

U.S. PATENT DOCUMENTS 2,236,791 A * 4/1941 Forsberg ..... A47L 15/18 134/172
2009/0056754 A1* 3/2009 Rolek ..... A47L 15/0018 134/18

* cited by examiner

*Primary Examiner* — Jason Y Ko

(57) ABSTRACT

A dish washing machine is provided herein. The dish washing machine includes a switching assembly configured to change a direction of washing water sprayed by a spray unit. The switching assembly includes a switching unit configured to change the direction of the washing water. The switching assembly also includes a damping unit configured to lessen vibrations of the switching unit. Using this structure, the direction of the washing water is efficiently changed by the switching unit, and vibrations and noise are lessened.

13 Claims, 10 Drawing Sheets

DISH WASHING MACHINE

CROSS-REFERENCE TO RELATED APPLICATIONS AND CLAIM OF PRIORITY

This application is a continuation of application Ser. No. 14/885,620, filed Oct. 16, 2015, which claims priority to Korean Patent Application No. 10-2014-0139424, filed on Oct. 16, 2014, the disclosures of which are incorporated herein by reference.

BACKGROUND

1. Field

Embodiment of the present disclosure relate to a dish washing machine, and more particularly, to a dish washing machine which has a structure to evenly spray washing water in a washing tub.

2. Description of the Related Art

In general, a dish washing machine is a machine to spray high pressure washing water to dishes and wash the dishes, and generally, performs a pre-washing, main washing, rinsing, and drying. In the pre-washing, the washing water is sprayed without providing detergent to remove leftovers. In the main washing, the washing water is sprayed and the detergent is provided simultaneously to wash the dishes.

SUMMARY

To address the above-discussed deficiencies, it is a primary object to provide, for use in a dish washing machine which includes spray units which spray washing water toward dish baskets, and a switching unit provided to change a direction of the washing water sprayed by the spray units, and prevents dead zones, where the washing water cannot reach, from occurring in a washing tub.

In addition, a dish washing machine is provided to lessen noise and vibrations of a switching unit which changes a direction of washing water sprayed by spray units. Additional aspects of the disclosure will be set forth in part in the description which follows and, in part, will be obvious from the description, or may be learned by practice of the disclosure.

In a first embodiment, a dish washing machine is provided. The dish washing machine includes a cabinet forming an exterior. The dishwashing machine also includes a washing tub which is provided in the cabinet and in which a dish is washed. The dish washing machine further includes a dish basket which is provided in the washing tub and is configured to accommodate the dish. In addition, the dish washing machine includes at least one spray unit configured to spray washing water into the washing tub. The dish washing machine includes a switching assembly configured to change a direction of the washing water sprayed by the at least one spray unit. The switching assembly includes a switching unit configured to change the movement of the washing water sprayed by the at least one spray unit toward the dish basket. The switching assembly also includes a damping unit provided in the switching unit and configured to lessen a vibration of the switching unit.

The switching unit can include a redirection surface of which at least a part of a surface which contacts the washing water to change a direction of the washing water sprayed by the at least one spray unit toward the dish basket is provided to be recessed, and the damping unit can be configured to support a rear surface of the redirection surface. The damping unit can be disposed to be in close contact with the rear surface of the redirection surface. The switching unit can further include a unit rear surface provided at a rear of the redirection surface, and the damping unit can be disposed between the rear surface of the redirection surface and the unit rear surface.

The switching unit can further include an insertion space formed between the redirection surface and the unit rear surface in a longitudinal direction of the switching unit, and the insertion space can include a damping section formed in at least a part of a section in a longitudinal direction of the switching unit and into which the damping unit is inserted. The dish washing machine can further include a guide rail provided so that the switching unit is movable. The switching unit can include a holder movably supported by the guide rail. The switching unit can also include a first switching unit disposed at a side of the holder. The switching unit can further include a second switching unit disposed at the other side of the holder. The damping section can include a first damping section formed in the first switching unit between a center of the first switching unit and the holder. The damping section can also include a second damping section formed in the second switching unit between a center of the second switching unit and the holder.

The switching unit can include a plurality of reinforcement ribs which connect the redirection surface and the unit rear surface. The damping section can be formed between one reinforcement rib of the plurality of reinforcement ribs and another reinforcement rib adjacent to the one reinforcement rib. The dish washing machine can further include a guide rail provided so that the switching unit is movable. The switching unit can further include a holder movably supported by the guide rail. The damping unit can be disposed adjacent to the holder.

The damping unit can be disposed to be spaced apart a predetermined distance from the holder in a direction of an end of the switching unit. The holder can be disposed at a center of the switching unit. A pair of the damping units can be provided at both sides around the holder. The pair of damping units can be disposed in the switching unit to be more adjacent to the holder than both ends of the switching unit centered on the holder. The damping unit can be detachably provided in the switching unit. In one of the switching unit and the damping unit, a damper coupling protrusion formed to protrude toward the other thereof can be provided, and in the other thereof, a damper coupling groove into which the damper coupling protrusion is inserted can be formed. The at least one spray unit can include a plurality of spray units separately disposed in a longitudinal direction of the switching unit. The damping unit can be disposed to correspond to a part on which the washing water sprayed by the plurality of spray units contacts the switching unit. The damping unit can be formed of an elastic material.

In a second embodiment, a dish washing machine is provided. The dish washing machine includes a cabinet forming an exterior. The dish washing machine also includes a washing tub which is provided in the cabinet and in which a dish is washed. The dish washing machine further includes a dish basket which is provided in the washing tub and is configured to accommodate the dish. In addition, the dish washing machine includes a spray unit configured to spray washing water into the washing tub. The dish washing machine includes a switching unit configured to change the movement of the washing water sprayed by the spray unit toward the dish basket. The switching unit includes at least one redirection surface of which at least a part of a surface which contacts the washing water to change a direction of the washing water sprayed by the spray unit toward the dish basket is provided to be recessed. The switching unit also includes a unit rear surface provided at a rear of the redirection surface. The dish washing machine includes a damping unit configured to support the redirection surface from the unit rear surface and is detachably provided.

The switching unit can include an insertion space provided between the redirection surface and the unit rear surface, and the damping unit can be configured to detach from the switching unit to open or close the insertion space. The switching unit can include at least one reinforcement rib which connects the redirection surface and the unit rear surface and crosses the insertion space. The at least one reinforcement rib can vertically support the redirection surface from the unit rear surface. The damping unit can horizontally support the redirection surface from the unit rear surface. The damping unit can be provided in a panel shape. The damping unit can include a unit body having a panel shape. The damping unit can also include a coupling protrusion which protrudes from the unit body. The redirection surface can include a groove-shaped coupling groove into which the coupling protrusion is insertable.

In a third embodiment, a dish washing machine is provided. The dish washing machine includes a cabinet forming an exterior. The dish washing machine also includes a washing tub which is provided in the cabinet and in which a dish is washed. The dish washing machine further includes a dish basket which is provided in the washing tub and is configured to accommodate the dish. In addition, the dish washing machine includes at least one spray unit configured to spray washing water into the washing tub. The dish washing machine includes a switching assembly configured to change a direction of the washing water sprayed by the at least one spray unit. The switching assembly includes a switching unit formed lengthwise in a first direction, and configured to move back and forth in a second direction perpendicular to the first direction. The switching assembly also includes a damping unit which is disposed in a damping section formed along at least a part of a longitudinal section in the first direction of the switching unit and is configured to lessen a vibration of the switching unit.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
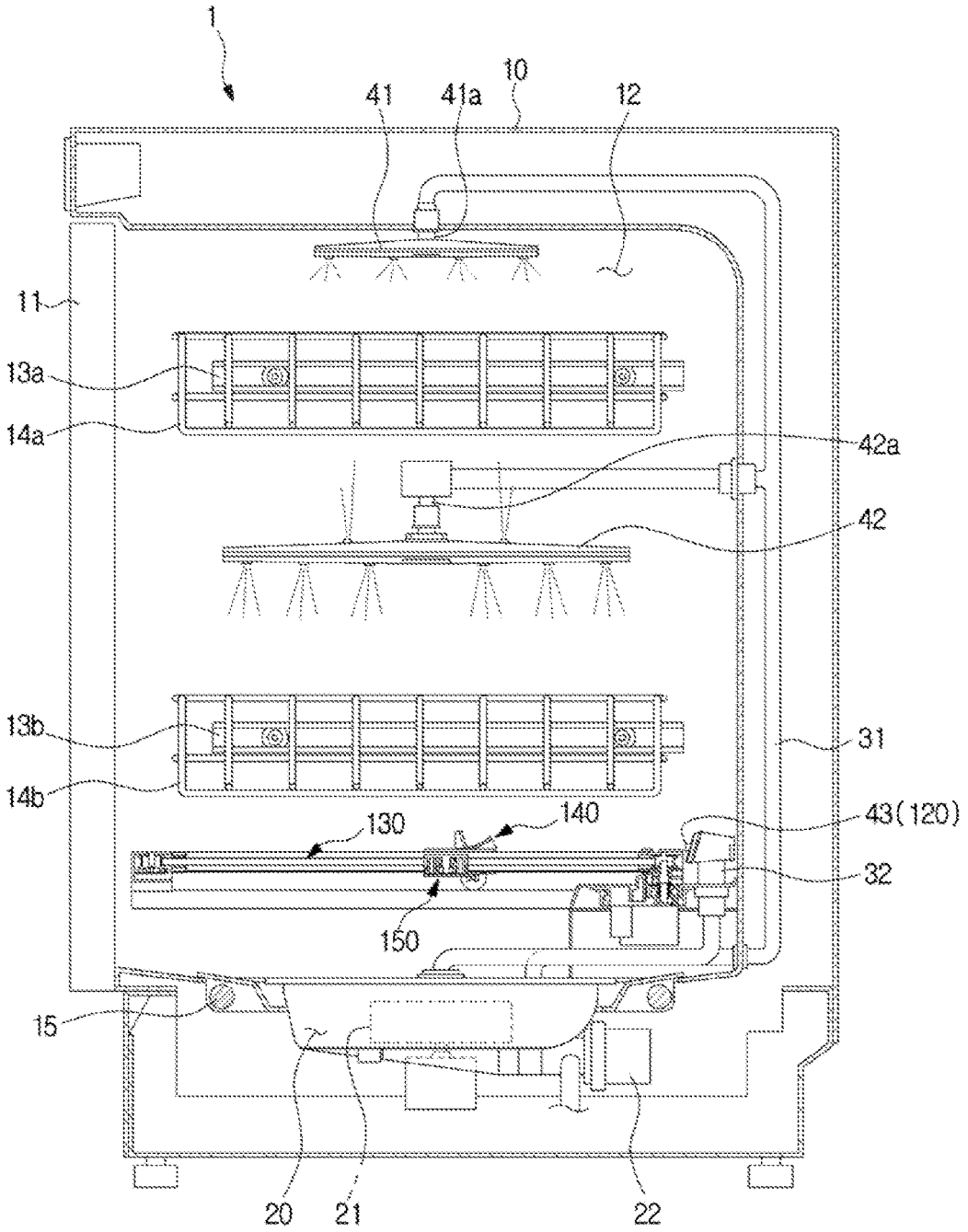
FIG. 1 is a cross-sectional view illustrating an example dish washing machine according to this disclosure.

FIGS. 1 through 10, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged washing machine or washing appliance. Reference will now be made in detail to the embodiments of the present disclosure, examples of which are illustrated in the accompanying drawings, wherein like reference numerals refer to like elements throughout.

Hereinafter, embodiments of the present disclosure are described in detail with reference to the accompanying drawings. The dish washing machine includes a cabinet in which a washing tub is provided, a pump which generates washing water pressure, a dish basket installed to store dishes and to move forward and backward in the washing tub, spray units which spray the washing water toward the dish basket, a connecting flow path which connects the pump and the spray unit, and a flow path switching valve configured to selectively move the washing water from the pump to a plurality of the spray units, wherein the washing water sprayed by the spray unit washes the dishes.

The dish basket includes an upper dish basket provided at an upper portion of the washing tub, and a lower dish basket provided at lower portion thereof. The spray units have been positioned over and under the dish basket, and over the lower dish basket. When the spray unit is provided to rotate, there are dead zones, where the washing water cannot reach, at the corners of the washing tub provided in a quadrangular shape. Structures, in which the lengths of the spray units are changed and the spray units rotate, have been proposed to prevent the dead zones to which the washing water cannot reach from occurring. The structures might prevent the dead zones to which the washing water cannot reach from occurring, however, in the structures in which the spray units rotate, due to the reaction of the spraying water pressure, a washing effect that the washing water is selectively or intensively sprayed to a specific area could not be obtained.

In addition, structures in which spray units, a driving unit to linearly move the spray units, and flow paths which connect the spray units and a pump are connected using links or flexible hoses have been proposed. However, the structures can have problems in that the pressure loss in the flow paths is great and the durability of the flow paths is low. In addition, when spray units are fixed to dish baskets, flow paths are inefficiently disposed and can cause a great flow path loss, and structures of the dish baskets are complicated.

Figure 2:
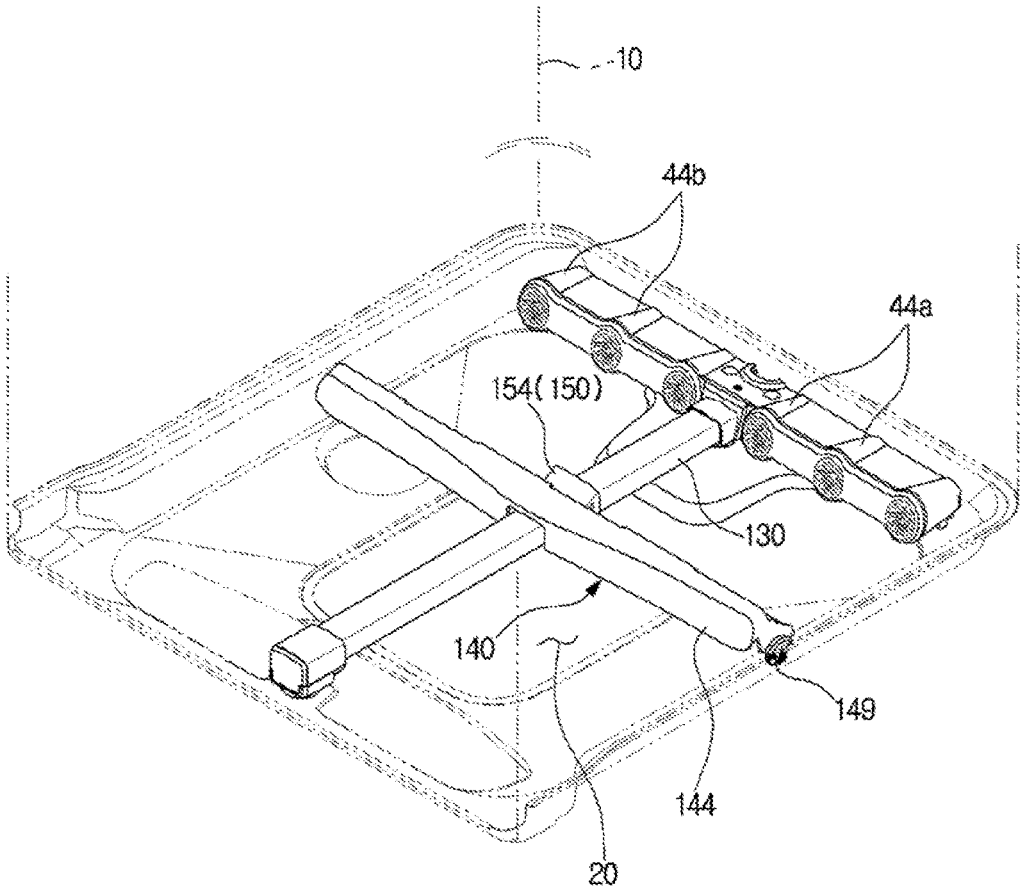
FIG. 2 is a partial perspective view illustrating an example dish washing machine according to this disclosure.
Figure 3:
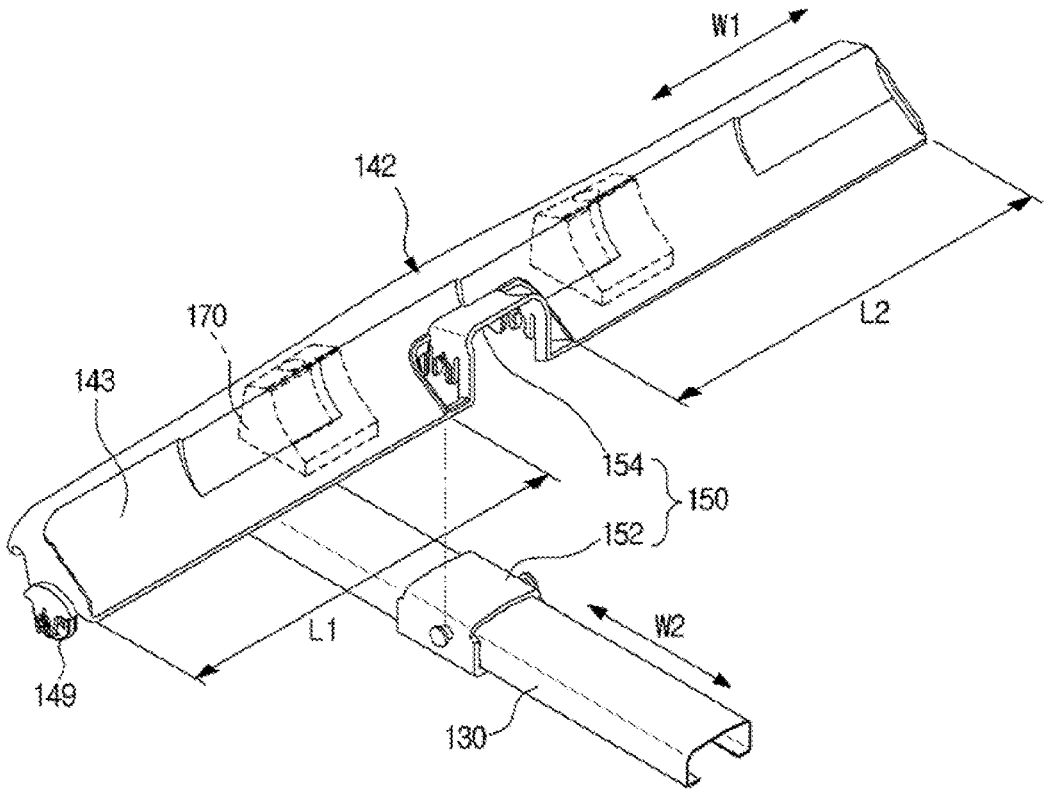
FIGS. 3 and 4 are exploded perspective views illustrating an example switching assembly of the dish washing machine according to this disclosure.
Figure 4:
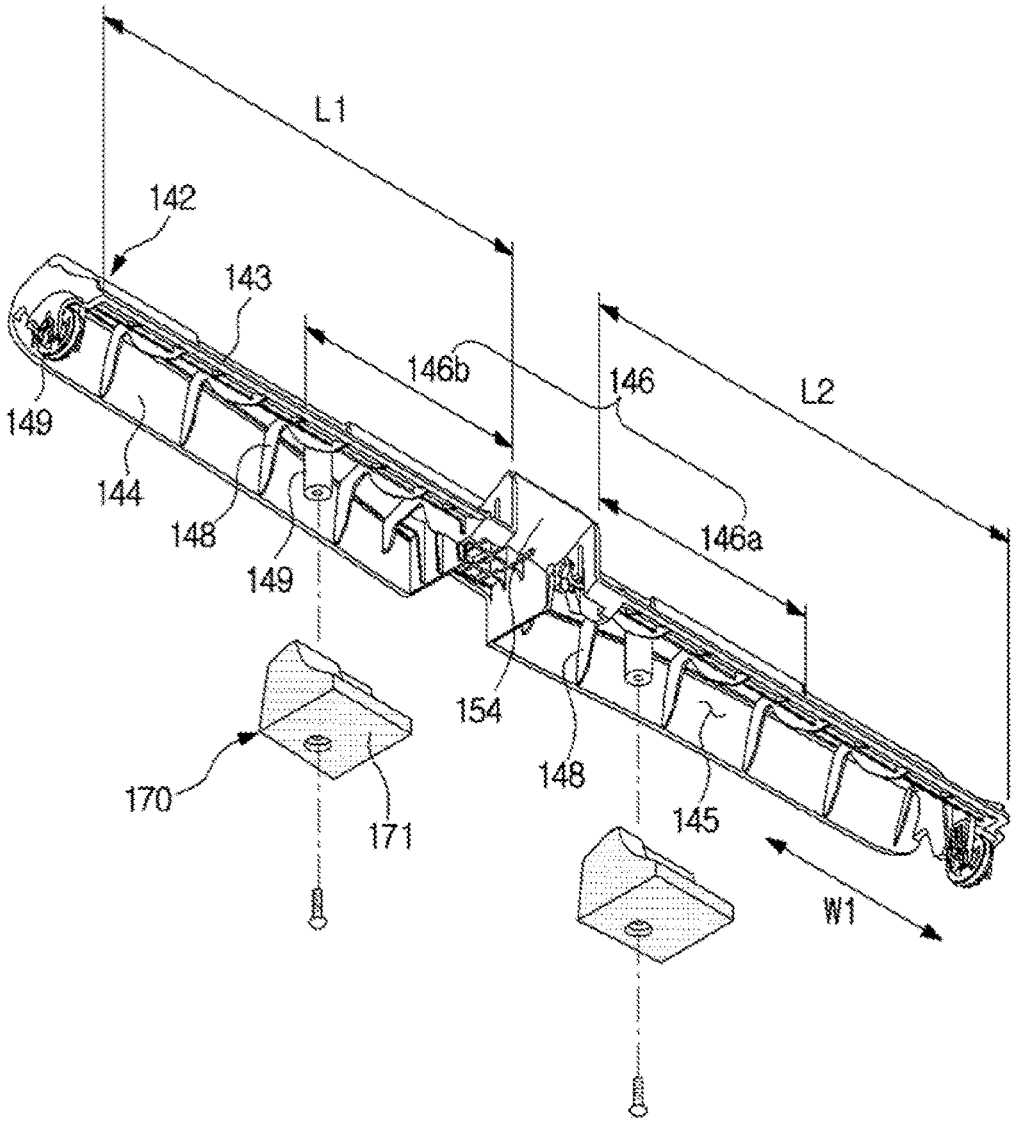
Figure 5:
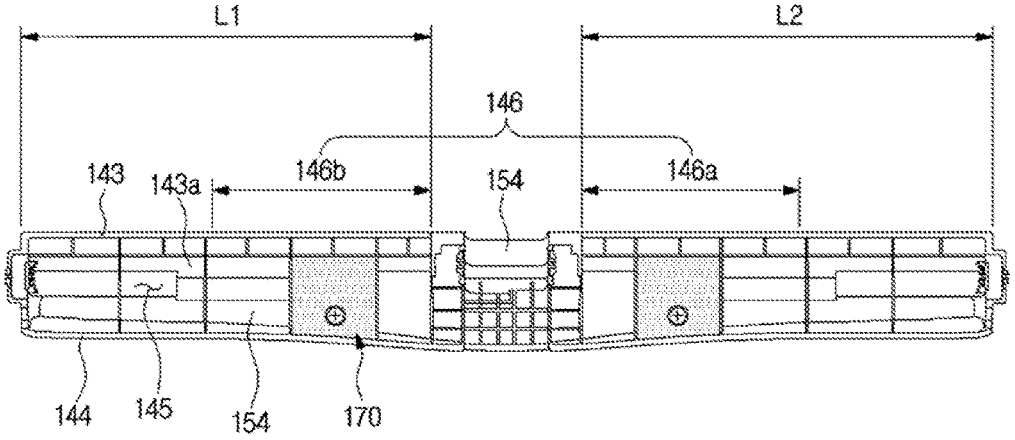
FIG. 5 is a front view illustrating an example lower portion of a switching unit of the dish washing machine according to this disclosure.
Figure 6:
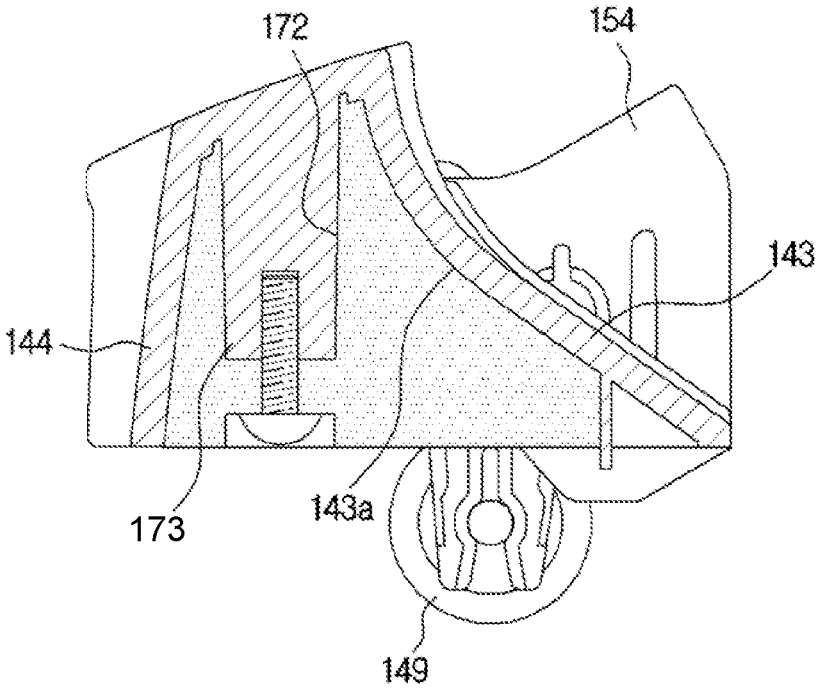
FIG. 6 is a cross-sectional view illustrating an example dish washing machine according to this disclosure.
Figure 7:
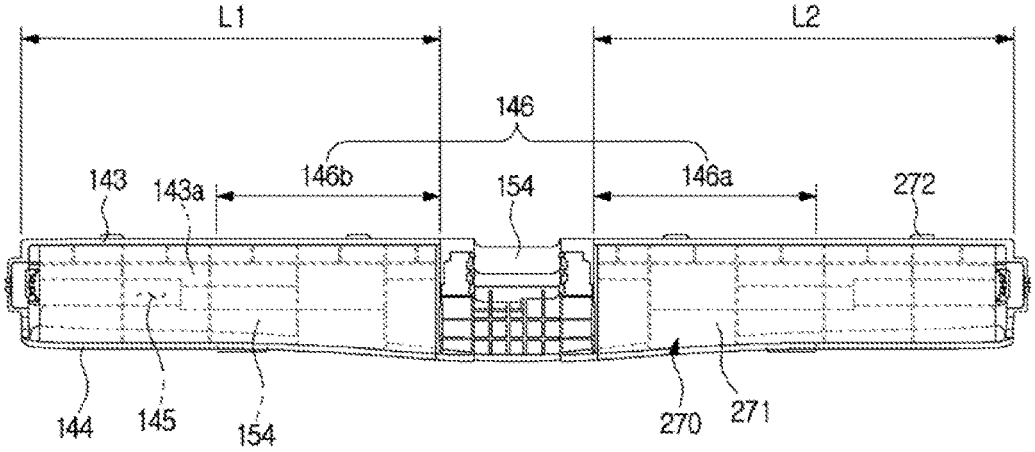
FIG. 7 is a front view illustrating an example lower portion of a switching unit of a dish washing machine according to this disclosure.
Figure 8:
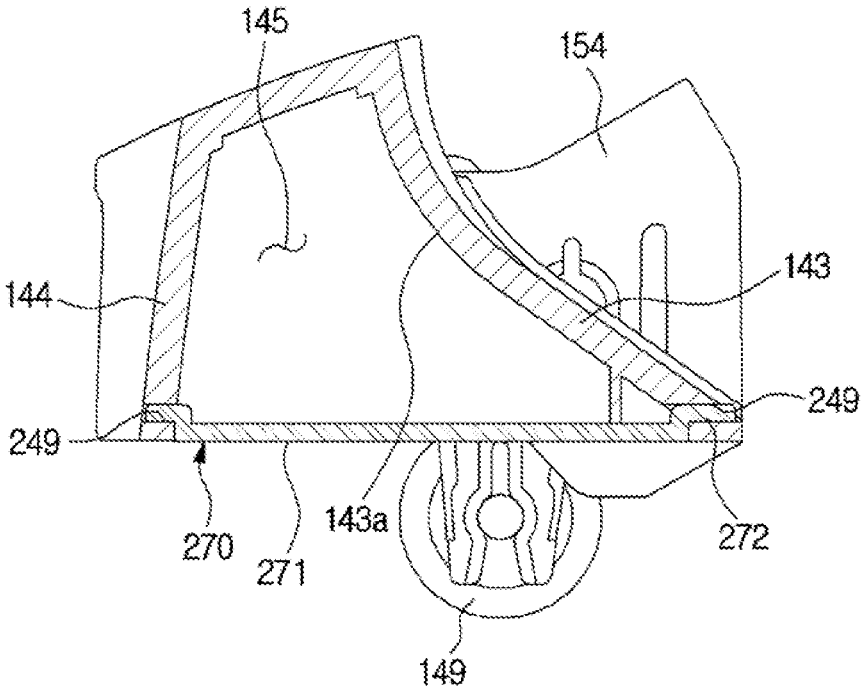
FIG. 8 is a cross-sectional view illustrating an example switching unit of the dish washing machine according to this disclosure.
Figure 9:
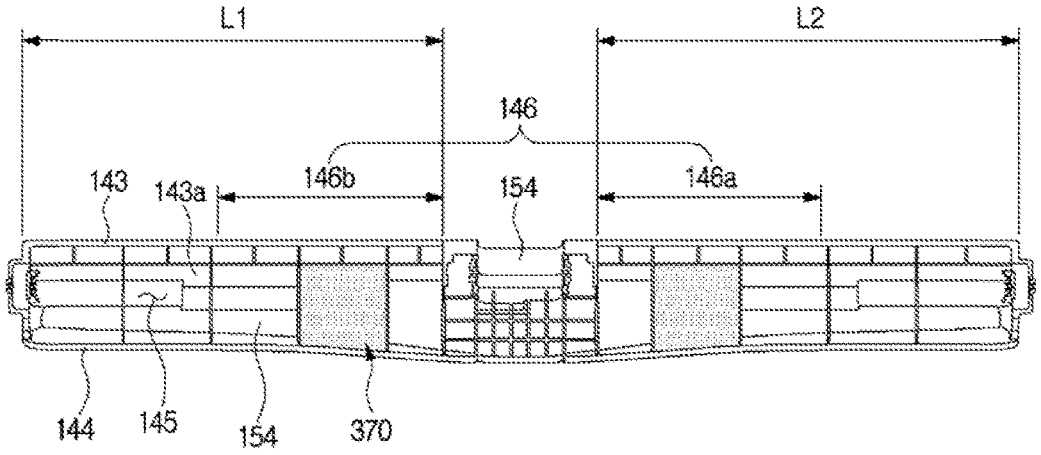
FIG. 9 is a front view illustrating an example lower portion of a switching unit of a dish washing machine according to this disclosure.
Figure 10:
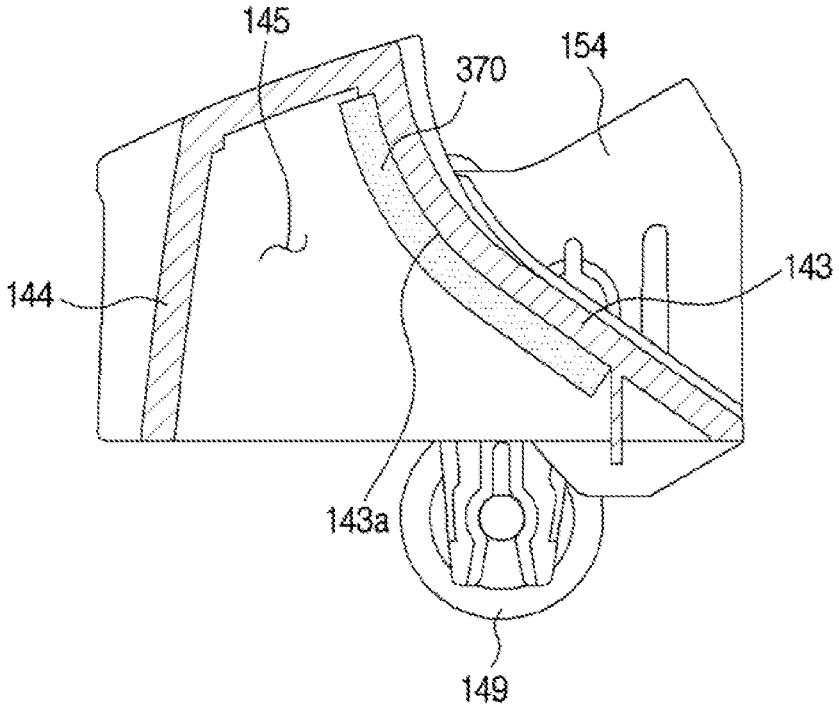
FIG. 10 is a cross-sectional view illustrating an example switching unit of the dish washing machine according to this disclosure.

FIG. 1 is a cross-sectional view illustrating an example dish washing machine according to this disclosure. FIGS. 2 and 3 are perspective views illustrating example parts of the dish washing machine according to this disclosure. FIG. 4 is an exploded perspective view illustrating an example part of the dish washing machine according to this disclosure.

A dish washing machine 1 includes a cabinet 10 which forms an exterior, a washing tub 12 provided inside the cabinet 10, dish baskets 14*a*,14*b* which are provided inside the washing tub 12 and store dishes, a sump 20 which collects and stores washing water, and spray units 41, 42, and 43 which spray the washing water. The washing tub 12 is provided in substantially a box shape and has an open front configured to allow the deposit or withdrawal of the dishes. The open front of the washing tub 12 is opened or closed by a door 11. The door 11 is rotatably coupled to the cabinet 10.

The dish baskets 14*a*, 14*b* includes an upper dish basket 14*a* and the lower dish basket 14*b*. The upper dish basket 14*a* is supported by an upper rack 13*a*, and the lower dish basket 14*b* is supported by a lower rack 13*b*. The upper rack 13*a* and the lower rack 13*b* are provided to be slidable back and forth inside the washing tub 12. A washing pump 21 is provided in the sump 20 to pump accommodated water into the spray units 41, 42, and 43. Washing water pumped by the washing pump 21 is supplied to a first spray unit 41 and a second spray unit 42 through a first supply pipe 31, or be supplied to the third spray unit 43 through a second supply pipe 32.

In addition, a heater 15 configured to heat washing water and a drain pump 22 configured to drain the washing water is provided under the washing tub 12. Meanwhile, as well illustrated in FIG. 1, the first spray unit 41 is provided over the upper dish basket 14*a*, the second spray unit 42 is provided between the upper dish basket 14*a* and the lower dish basket 14*b*, and the third spray unit 43 is provided under the lower dish basket 14*b*. In addition, the first spray unit 41 is provided to rotate around a rotation shaft 41*a*, and the second spray unit 42 is provided to rotate around a rotation shaft 42*a*.

The first spray unit 41 sprays washing water toward dishes accommodated in the upper dish basket 14*a*, and the second spray unit 42 sprays washing water toward dishes accommodated in the upper dish basket 14*a* and the lower dish basket 14*b*. Meanwhile, the third spray unit 43 is provided to be fixed at one side of the washing tub 12 unlike the first spray unit 41 and the second spray unit 42. The third spray unit 43 sprays washing water in substantially a horizontal direction, and accordingly the washing water sprayed by the third spray unit 43 may not directly move toward dishes.

The third spray unit 43 includes a plurality of nozzles 44*a*, 44*b* which spray washing water, and a plurality of heads which supply the washing water to the plurality of nozzles 44*a*, 44*b*. Each of the plurality of nozzles 44*a*, 44*b* is spaced a predetermined interval and arrayed in a line approximately from one side to the opposite side of the washing tub. The plurality of heads includes the left head and the right head, nozzles 44*a* are provided at the left head, and nozzles 44*b* are provided at the right head. The second supply pipe 32 is divided into a supply pipe which supplies washing water to the left head and a supply pipe which supplies washing water to the right head. A direction of the washing water sprayed in substantially a horizontal direction by the nozzles 44*a*, 44*b* of the third spray unit 43 is changed by a switching assembly disposed inside the washing tub 12, and the washing water moves toward the dishes accommodated in the lower dish basket 14*b*.

Hereinafter, the third spray unit 43 will be referred to as a spray unit 120 for the sake of convenience in the description. The switching assembly 140 is provided to change the direction of the washing water sprayed by the spray unit 120. The switching assembly 140 is provided to face the spray unit 120 to change the direction of the washing water sprayed by the spray unit 120 toward the dish basket 14*b*. The switching assembly 140 is provided at least one side over or under the dish basket 14*b*, and provided to change the direction of the washing water sprayed by the spray unit 120 and to wash the dishes inside the dish basket 14*b*.

The switching assembly 140 includes a switching unit 142. The switching unit 142 is provided to change the direction of the washing water sprayed by the spray unit 120, and to face the spray unit 120. The switching unit 142 extends lengthwise in a direction of a disposition of the spray unit 120 to change the direction of the whole of the washing water sprayed by the spray unit 120.

The switching unit 142 includes redirection surfaces 143 to change the moving direction of the washing water. The redirection surface 143 is formed in a recessed shape, and be provided to change the direction without repulsion when the washing water contacts the redirection surface 143. The redirection surface 143 is formed to have the same shape in a longitudinal direction, or is provided to have a shape with varying degrees of curvature in the longitudinal direction. At least a part of a contact surface to change the direction of the washing water sprayed by the at least one spray unit 120 toward the dish basket 14*b* due to the redirection surface 143 is concavely provided. The switching unit 142 includes unit rear surfaces 144 disposed at rear sides of the redirection surfaces 143, and insertion spaces 145 provided between the redirection surfaces 143 and the unit rear surfaces 144. A lower portion of the switching unit 142 is provided to be opened, and the insertion space 145 is formed between a rear surface of the redirection surface 143 and the unit rear surface 144.

Rollers 149 are provided at both longitudinal ends of the switching unit 142 to balance the switching unit 142. The rollers 149 are supported by support rails (not shown) provided in the washing tub 12. The switching assembly 140 includes a holder 150 provided to move or rotate the switching unit 142. The holder 150 is provided so that the switching unit 142 is supported by a guide rail 130, and includes a guide holder 152 and a switching unit holder 154.

The guide holder 152 is provided so that the switching unit 142 moves along the guide rail 130. Specifically, when a longitudinal direction of the switching unit 142 is a first direction, the guide rail 130 is provided so that the switching unit 142 moves parallel to a second direction perpendicular to the first direction. The guide rail 130 is provided so that the switching assembly 140 moves back and forth on the guide rail 130 and extends a spray range of the washing water toward the dish basket 14*b*. The switching unit holder 154 also is formed separate from the switching unit 142, and can be integrally formed therewith.

The switching unit holder 154 is rotatably coupled to the guide holder 152, and accordingly, is rotatably provided with the switching unit 142. The switching assembly 140 includes damping units 170. The damping unit 170 is provided to support at least a part of the switching unit 142 to lessen vibrations of the switching unit 142. The damping units 170 are provided to support rear surfaces 143*a* of the redirection surfaces 143. The damping unit 170 is provided to support the rear surface 143*a* of the redirection surface 143, and to absorb an impact of the washing water transferred to the redirection surface 143.

The damping unit 170 is provided to closely contact the rear surface 143*a* of the redirection surface 143. The damping unit 170 is provided to closely contact the rear surface 143*a* of the redirection surface 143, and to effectively absorb the impact caused by the washing water which contacts the redirection surface 143. The damping unit 170 is provided to fill the inside of the switching unit 142. The damping unit 170 is provided between the rear surface 143*a* of the redirection surface 143 and the unit rear surface 144. That is, as the damping unit 170 is disposed from the rear surface 143*a* of the redirection surface 143 to the unit rear surface 144 along a lengthwise area, the damping unit 170 is provided to absorb the direct impact caused by the washing water sprayed by the spray unit 120.

That is, the damping unit 170 is formed of an elastic material. Since the damping unit 170 has an elastic characteristic, the damping unit 170 absorbs the impact caused by the washing water sprayed by the spray unit 120. The damping unit 170 is provided in at least a part of the insertion space 145 provided between the rear surface 143*a* of the redirection surface 143 and the unit rear surface 144. That is, the damping unit 170 is formed to fill an entire inside of the switching unit 142, and also is disposed at a partial section thereof for effective disposition.

The damping unit 170 is provided in the switching unit 142, and provided to change a natural frequency of the switching unit 142. The switching unit 142 vibrates due to the washing water sprayed by the spray unit 120, the switching unit 142 vibrates at the natural frequency. As the damping unit 170 is disposed in at least a partial section of the switching unit 142 and changes the natural frequency of the switching unit 142, the vibrations are lessened even though the switching unit 142 is impacted by the washing water. As described herein, since the damping unit 170 has the elastic characteristic and is formed as a separate mass with the switching unit 142, the damping unit 170 serves to lessen vibrations caused by a direct impact of the washing water on a part in which the damping unit 170 is disposed and an indirect impact, not the direct impact, to the damping unit 170.

Hereinafter, a disposition of the damping unit 170 will be described. The damping unit 170 is formed in at least a partial section of the switching unit 142. The switching unit 142 includes a damping section 146 in which the damping unit 170 is disposed. The damping section 146 is disposed adjacent to the switching unit holder 154 to support a movement of the switching unit 142 in the switching unit 142. That is, in the embodiment of the present disclosure, since the switching unit holder 154 is disposed at a center of the switching unit 142, the damping section 146 is disposed more adjacent to the switching unit holder 154 than ends of the switching unit 142. However, the length and the position of the damping section 146 are not limited thereto.

The damping unit 170 will be described according to a relation with the holder 150. The damping unit 170 is spaced apart from the holder 150 by a predetermined distance in a direction of the ends of the switching unit 142. The washing water sprayed by the spray unit 120 is provided to be sprayed toward the pair of redirection surfaces 143 disposed at both sides of the holder 150. The damping units 170 are provided in a pair at the rear surfaces 143*a* of the pair of redirection surfaces 143. Since the pair of damping units 170 are spaced apart a predetermined distance from the holder 150 in a direction toward the ends of the switching unit 142, the pair of damping units 170 improves a damping effect to the ends of the switching unit 142 which has greater vibrations than the holder 150 supported by the guide rail 130.

The damping unit 170 will be described according to a relation with the spray unit 120. In the embodiment, the at least one spray unit 120 includes a plurality of spray units 120 spaced apart in a longitudinal direction of the switching unit 142. The switching unit 142 is formed lengthwise in a first direction W1, and be provided to move back and forth in a second direction W2 perpendicular to the first direction W1. The plurality of spray units 120 are separated from the switching unit 142 by a predetermined distance, and be spaced apart in the first direction W1 to correspond to the switching unit 142. Washing water sprayed by the plurality of spray units 120 is sprayed toward the redirection surfaces 143 of the switching unit 142 and washes the dishes.

For the convenience of description, a first section L1 is defined as one end of switching unit 142, and a second section L2 is defined as the other end thereof, with respect to the holder 150. The damping units 170 are disposed at a section formed between a center of the first section L1 and the holder 150 and a section formed between a center of the second section L2 and the holder 150. The section formed between the center of the first section L1 and the holder 150 refers to a first damping section 146*b*, the section formed between the center of the second section L2 and the holder 150 refers to a second damping section 146*a*, and the damping units 170 is provided in a pair and be respectively disposed in the first damping section 146*b* and the second damping section 146*a*. Through the disposition described herein, vibrations caused by an impact of the washing water sprayed by the spray unit 120 on the switching unit 142 are lessened. In the embodiment, however, it is exemplified that the damping section 146 includes the first damping section 146*b* and the second damping section 146*b*, but is not limited thereto. Like the damping unit 170 disposed in the drawing, it is fine that the damping section 146 is formed to be smaller than the first damping section 146*b* and the second damping section 146*a*.

In a different method, the damping unit 170 is disposed to correspond to a part in which the washing water sprayed by the plurality of spray units 120 contacts the switching unit 142. That is, the damping unit 170 is disposed on a rear surface of the part of which the washing water contacts the redirection surface 143. Thus, a direct impact of the washing water is absorbed.

The switching unit 142 includes at least one reinforcement rib 148. The at least one reinforcement rib 148 is provided to connect the rear surface 143*a* of the redirection surface 143 of the switching unit 142 and the unit rear surface 144. The at least one reinforcement rib 148 includes a plurality of reinforcement ribs 148. The plurality of reinforcement ribs 148 is spaced in parallel and apart from each other. The plurality of reinforcement ribs 148 is disposed to divide the insertion spaces 145 into a plurality of sections. The damping section 146 is formed between one reinforcement rib 148 of the plurality of reinforcement rib 148 and a different reinforcement rib 148 adjacent to the one reinforcement rib 148.

The damping unit 170 is detachably provided at the switching unit 142. The damping units 170 include unit bodies 171, and damping coupling grooves 172 provided in the unit bodies 171. The unit body 171 is formed to have a predetermined mass, and formed to closely contact the rear surface 143*a* of the redirection surface 143, or to closely contact both of the rear surface 143*a* of the redirection surface 143 and the unit rear surface 144. As described herein, the unit body 171 is disposed at the damping section 146.

The damping coupling groove 172 is provided to be coupled to a damping coupling protrusion 173 provided at switching unit 142. Specifically, the damping coupling protrusion 149 is inserted into and coupled to the damping coupling groove 172, the damping coupling protrusion 173 and the damping coupling groove 172 each is configured to be threaded at insides thereof, and thus both components is coupled. It is described as the embodiment that the damping coupling groove 172 and the damping coupling protrusion 173 are respectively disposed at the damping unit 170 and the switching unit 142, however, it is also fine that the damping coupling groove 172 is provided at the switching unit 142 and the damping coupling protrusion 173 is provided at the damping unit 170. In addition, the coupling of the switching unit 142 and the damping unit 170 is not limited to the above description. Hereinafter, a dish washing machine according to a second embodiment of the present disclosure will be described.

In the description of the embodiment, duplicated contents of the first embodiment will be omitted. A switching assembly 140 includes damping units 270. The damping unit 270 is provided to support at least a part of a switching unit 142 to lessen vibrations of the switching unit 142. The damping units 270 are provided to support redirection surfaces 143 from unit rear surfaces 144. In the switching unit 142, insertion spaces 145 formed by the redirection surfaces 143 and the unit rear surfaces 144 are provided to form openings at lower portions thereof and to be opened, and the damping units 270 are disposed at the openings and open or close the insertion spaces 145. The damping unit 270 is provided to open or close the opening, and provided to be removable from the redirection surface 143 and/or the unit rear surface 144.

A shape of the damping unit 270 is not limited, however, the damping unit 270 is provided in a panel shape in the embodiment. The damping unit 270 is provided to support the redirection surface 143 from the unit rear surface 144. Since the switching unit 142 is formed lengthwise in a first direction W1 which is a longitudinal direction, the damping unit 270 also is formed lengthwise in the first direction W1 and disposed at the opening of the insertion space 145. The switching unit 142 includes at least one reinforcement rib 148.

The at least one reinforcement rib 148 is provided to connect a rear surface 143*a* of the redirection surface 143 of the switching unit 142 and the unit rear surface 144. The at least one reinforcement rib 148 includes a plurality of reinforcement ribs 148. The plurality of reinforcement ribs 148 is spaced apart and in parallel. The plurality of reinforcement ribs 148 is provided to divide the insertion spaces 145 into a plurality of sections. A damping section 146 is formed between one reinforcement rib 148 of the plurality of reinforcement ribs 148 and a different reinforcement rib 148 adjacent to the one reinforcement rib 148.

The at least one reinforcement rib 148 is provided to vertically support the redirection surface 143 from the unit rear surface 144, and the damping unit 270 is provided to horizontally support the redirection surface 143 from the unit rear surface 144. In other words, the at least one reinforcement rib 148 is provided to support the redirection surface 143 from the unit rear surface 144 to be vertical to the first direction W1, and the damping unit 270 is provided to support the redirection surface 143 from the unit rear surface 144 in a direction parallel to the first direction W1.

The damping units 270 includes unit bodies 271 having a panel shape, and coupling protrusions 272 which protrude from the unit bodies. Coupling grooves 249 having a groove shape are formed in the switching unit 142 so that the coupling protrusions 272 are inserted therein. In the embodiment of the present disclosure, the coupling protrusions 272 are provided in a plural number, and spaced apart from the unit bodies 271 in the first direction W1. The coupling grooves 249 are provided in a plural number to correspond to the plurality of coupling protrusions 272, and spaced apart from the redirection surface 143 or/and the unit rear surface 144 in the first direction W1. Hereinafter, a dish washing machine according to a third embodiment of the present disclosure will be described.

In the description of the embodiment, duplicated contents of the first embodiment will be omitted. A switching assembly 140 includes damping units 370. The damping unit 370 is provided to support at least a part of a switching unit 142 to lessen vibrations of the switching unit 142. The damping unit 370 is provided to support a rear surface 143*a* of a redirection surface 143. The damping unit 370 is provided to support the rear surface 143*a* of the redirection surface 143, and to absorb an impact of washing water transferred to the redirection surface 143.

The damping unit 370 is provided to closely contact the rear surface 143*a* of the redirection surface 143. The damping unit 370 is provided to closely contact the rear surface 143*a* of the redirection surface 143, and to effectively absorb the impact caused by the washing water which contacts the redirection surface 143. That is, the damping unit 370 is formed of an elastic material. Since the damping unit 370 includes the elastic material, the impact caused by the washing water sprayed by the spray unit 120 is absorbed.

The damping unit 370 is provided in a flexible sheet shape. The damping unit 370 is provided to surround the rear surface 143*a* of the redirection surface 143, and is disposed at a damping section 146. The damping unit 370 having the sheet shape closely contacts the rear surface 143*a* of the redirection surface 143 and the vibrations caused by the impact of the washing water is lessened. As is apparent from the above description, since a switching unit is included in addition to a spray unit, dead zones where washing water cannot reach is removed. In addition, since vibrations of a switching unit which contacts washing water sprayed by a spray unit are lessened, washing efficiency is improved and noise is lessened.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A dish washing machine comprising:

a cabinet forming an exterior;

a washing tub provided in the cabinet and in which a dish is washed;

a dish basket provided in the washing tub and configured to accommodate the dish;

at least one spray unit configured to spray washing water toward a switching assembly in the washing tub; and the switching assembly is configured to change a direction of the washing water sprayed by the at least one spray unit, wherein the switching assembly includes:

a switching unit configured to change a movement of the washing water sprayed by the at least one spray unit toward the dish basket, and a damping unit provided in the switching unit and configured to lessen a vibration of the switching unit, wherein the switching unit includes:

a redirection surface configured to contact the washing water to change a direction of the washing water sprayed by the at least one spray unit toward the dish basket and having at least a part formed as a curved surface, and a unit rear surface disposed opposite the redirection surface, and wherein the damping unit is disposed between the redirection surface and the unit rear surface to support the redirection surface.

2. The dish washing machine of claim 1, wherein the damping unit is further configured to be in close contact with a back surface of the redirection surface.

3. The dish washing machine of claim 1, wherein:

the switching unit further includes an insertion space formed between the redirection surface and the unit rear surface in a longitudinal direction of the switching unit, and the insertion space includes a damping section formed in at least a part of a section in a longitudinal direction of the switching unit and into which the damping unit is inserted.

4. The dish washing machine of claim 3, further comprising a guide rail provided so that the switching unit is movable, wherein the switching unit includes:

a holder movably supported by the guide rail, a first switching unit disposed at a side of the holder, and a second switching unit disposed at another side of the holder, and wherein the damping unit includes:

a first damping section formed in the first switching unit between a center of the first switching unit and the holder, and a second damping section formed in the second switching unit between a center of the second switching unit and the holder.

5. The dish washing machine of claim 2, wherein:

the switching unit includes a plurality of reinforcement ribs configured to connect the redirection surface and the unit rear surface, and the damping unit is formed between one reinforcement rib of the plurality of reinforcement ribs and another reinforcement rib adjacent to the one reinforcement rib.

6. The dish washing machine of claim 1, further comprising a guide rail provided so that the switching unit is movable, wherein the switching unit further includes a holder movably supported by the guide rail, and wherein the damping unit is disposed adjacent to the holder.

7. The dish washing machine of claim 6, wherein the damping unit is disposed to be spaced apart a predetermined distance from the holder in a direction of an end of the switching unit.

8. The dish washing machine of claim 6, wherein:

the holder is disposed at a center of the switching unit, where a pair of damping units are provided at both sides around the holder, and the pair of damping units are disposed in the switching unit to be closer to the holder than both ends of the switching unit centered on the holder.

9. The dish washing machine of claim 1, wherein the damping unit is detachably provided in the switching unit.

10. The dish washing machine of claim 1, wherein:

in one of the switching unit and the damping unit, a damper coupling protrusion formed to protrude toward the other thereof is provided, and in the other thereof, a damper coupling groove, into which the damper coupling protrusion is inserted, is formed.

11. The dish washing machine of claim 1, wherein:

the at least one spray unit includes a plurality of spray units disposed to be spaced apart in a longitudinal direction of the switching unit, and the damping unit is disposed to correspond to a part at which the washing water sprayed by the plurality of spray units contacts the switching unit.

12. The dish washing machine of claim 1, wherein the damping unit is formed of an elastic material.

13. A dish washing machine comprising:

a cabinet forming an exterior;

a washing tub provided in the cabinet and in which a dish is washed;

a dish basket provided in the washing tub and configured to accommodate the dish;

at least one spray unit configured to spray washing water into the washing tub; and a switching assembly configured to change a direction of the washing water sprayed by the at least one spray unit, wherein the switching assembly includes:

a switching unit formed lengthwise in a first direction, and configured to move back and forth in a second direction perpendicular to the first direction; and a damping unit disposed in a damping section formed along at least a part of a longitudinal section in the first direction of the switching unit, and configured to lessen a vibration of the switching unit, wherein the switching unit includes a redirection surface configured to contact the washing water to change a direction of the washing water sprayed by the at least one spray unit toward the dish basket and having at least a part formed as a curved surface, and wherein the damping unit is disposed between the redirection surface and a unit rear surface located opposite the redirection surface to support the redirection surface.

* * * * *